US005864918A

United States Patent [19]

Kosick

[11] Patent Number: 5,864,918

[45] Date of Patent: Feb. 2, 1999

[54] DEVICE FOR APPLYING PAINT ON SURFACES

[76] Inventor: Günther Kosick, Mittelmähder 17, D-86707 Kühlenthal, Germany

[21] Appl. No.: 808,684

[22] Filed: Feb. 28, 1997

[30] Foreign Application Priority Data

Mar. 22, 1996 [DE] Germany ..... 196 11 284.2

[51] Int. Cl.[6] ..... A46B 17/00

[52] U.S. Cl. ..... 15/248.2; 15/230.11; 492/19

[58] Field of Search ..... 15/230.11, 248.1, 15/248.2; 492/17, 19

[56] References Cited

U.S. PATENT DOCUMENTS

| | | | |
|---|---|---|---|
| 2,817,868 | 12/1957 | Pharris et al. | 15/248.2 |
| 2,835,915 | 5/1958 | Pearson | 15/248.2 |
| 3,115,659 | 12/1963 | Church | 15/230.11 |
| 3,252,290 | 5/1966 | Powers | 15/248.2 |
| 4,337,002 | 6/1982 | Martucci | 15/248.2 |

FOREIGN PATENT DOCUMENTS

| | | | |
|---|---|---|---|
| 1102458 | 2/1988 | United Kingdom | 15/248.1 |

*Primary Examiner*—Terrence Till
*Attorney, Agent, or Firm*—Jones, Tullar & Cooper, P.C.

[57] ABSTRACT

In a device for applying paint on surfaces, more particularly on ceilings and walls by means of a paint roller, mounted in rotating position on a stirrup which can be attached to a stirrup carrier, preferably a handle clean and comfortable working and high safety standard is ensured due to a paint roller to which a device for the protection against sprays is assigned, the device being retractable from a work position, which encloses the circumference of the paint roller at the side of the stirrup carrier like a tub, into a release position releasing the paint roller and vice versa.

13 Claims, 3 Drawing Sheets

DEVICE FOR APPLYING PAINT ON SURFACES

BACKGROUND OF THE INVENTION

The present invention relates to a device for applying paint on surfaces, more particularly on ceilings and/or walls, by means of a paint roller which is mounted on a stirrup in a rotable manner which can be joined to a stirrup carrier, preferably having the shape of a handle.

In known devices of this kind a which are used extensively in private households as well as professionally, the paint roller is fully accessible from the outside along its circumference. As much as this is desirable when the paint roller is immersed into a paint container and when the paint roller is wiped off on a grid there is, however, the danger of paint dripping or spraying from the paint roller when the paint is applied on the surface to be painted. In this connection it can be assumed that due to the rotational movement of the paint, roller paint drips are flung off and/or that due to too much pressure on the paint roller, paint is squeezed out. In known setups, however, there is the danger that the floor in the room where the painting is done is soiled by paint drops. It is therefore required to cover the floor and possibly other objects in the room by a plastic sheet. This is, however, not only awkward and costly but also constitutes a major risk of accidents.

SUMMARY OF THE INVENTION

It is therefore an object of the present invention to improve a device as mentioned above by using simple and inexpensive means so that paint can be applied without the risk of paint drops or paint sprays while the paint roller can be reliably immersed into a paint container and wiped off on a paint grid.

In accordance with the present invention a device for the protection of paint sprays is assigned to the paint roller, the device being retractable from a work position, in which the device encloses the circumference of the paint roller at the side of the stirrup carrier like a tub, into a release position releasing the paint roller and vice versa.

These measures fully prevent the disadvantages of the known devices as mentioned before without rendering the immersing of the paint roller difficult. Since the device for the protection against paint sprays can be retracted from the work position enclosing the paint roller into the release position and vice versa, it is ensured that on the one hand the paint roller can be immersed reliably and unhindered into a paint container while on the other hand unavoidable paint drops are reliably collected while the paint is applied. A cover that had been required before is no longer necessary. Since unavoidable paint drops or paint sprays can be collected, the application of paint requires less attention or skill than previously, thus making painting easy in particular for helpers and laymen. With the measures according to the present invention it becomes obvious that a tool that can be considered as a mass article has been considerably improved.

Advantageous embodiments and expedient developments of the above mentioned measures will become evident from the following. The device for the protection against paint sprays can have the shape of a tub which is attached to a tube through which the handle runs that is assigned to the stirrup. Through these measures the handling of the setup according to the present invention is very easy and obvious. The combination of handle and tube with the device for the protection against sprays replaces the conventional handle.

When the paint roller is used up it can easily be replaced together with the corresponding stirrup.

Another useful measure may consist in the device for the protection against paint sprays being movable against the power of a return spring which is provided within the tube-shaped handle and is supported on the one hand by the end of the handle at the remote end of the paint roller and on the other hand by a tongue attached to the tube and passing through a slot of the handle. The return spring ensures that the device for the protection against paint sprays can be moved reliably into the work position and is held in this position. Through the tongue of the tube passing through the slot of the handle a pin-slot-connection is created ensuring resistance to twisting and creating stoppers at the same time.

In a further development of the above mentioned measures the device for the protection against paint sprays can be blocked by means of an engaging device in at least the retracted release position. This makes the handling of the paint roller with one hand easier which is particularly desirable when loading paint.

The stirrup containing the paint roller may be provided with a plate which closes a recess in the tub through which the stirrup runs during the working position.

This ensures an advantageous and easy passing through of the stirrup through the tub bottom during the working phase. The stirrup can therefore easily be screwed together with the handle ending outside of the tub.

The device for the protection against paint sprays may be a part which is separate from the tube and may be fixed to it in a releasable connection, preferably formed of plastic. This not only allows easy production but also enables the easy removal of the device for the protection against paint sprays from the tube for cleaning purposes etc.

Further preferable embodiments and expedient developments of the above mentioned measures are contained in the claims and may be derived from the following description.

BRIEF DESCRIPTION OF THE DRAWINGS

In the following a preferred embodiment of the invention will be illustrated in detail by means of the drawings, wherein.

DETAILED DESCRIPTION OF THE PREFERRED EMBODIMENTS

The device for applying paint according to the present invention as clearly shown in FIGS. 1 to 4 consists of a paint roller 1 which is coated in a known manner with textile material; the paint roller 1 is mounted on a stirrup 2 in a rotable manner, formed of a bent round rod. The stirrup 2 possesses two shanks connected with each other by a bridge, one of them serving as the axis which receives the paint roller 1 and the other being bent at half length of the roller, screwing into a stud bolt by which the stirrup 2 can be screwed to a stirrup carrier. A handle 3 acts as stirrup carrier and is provided at its front end with a threaded sleeve 4 assigned to the stud bolt near the side of the stirrup.

Figure 3:
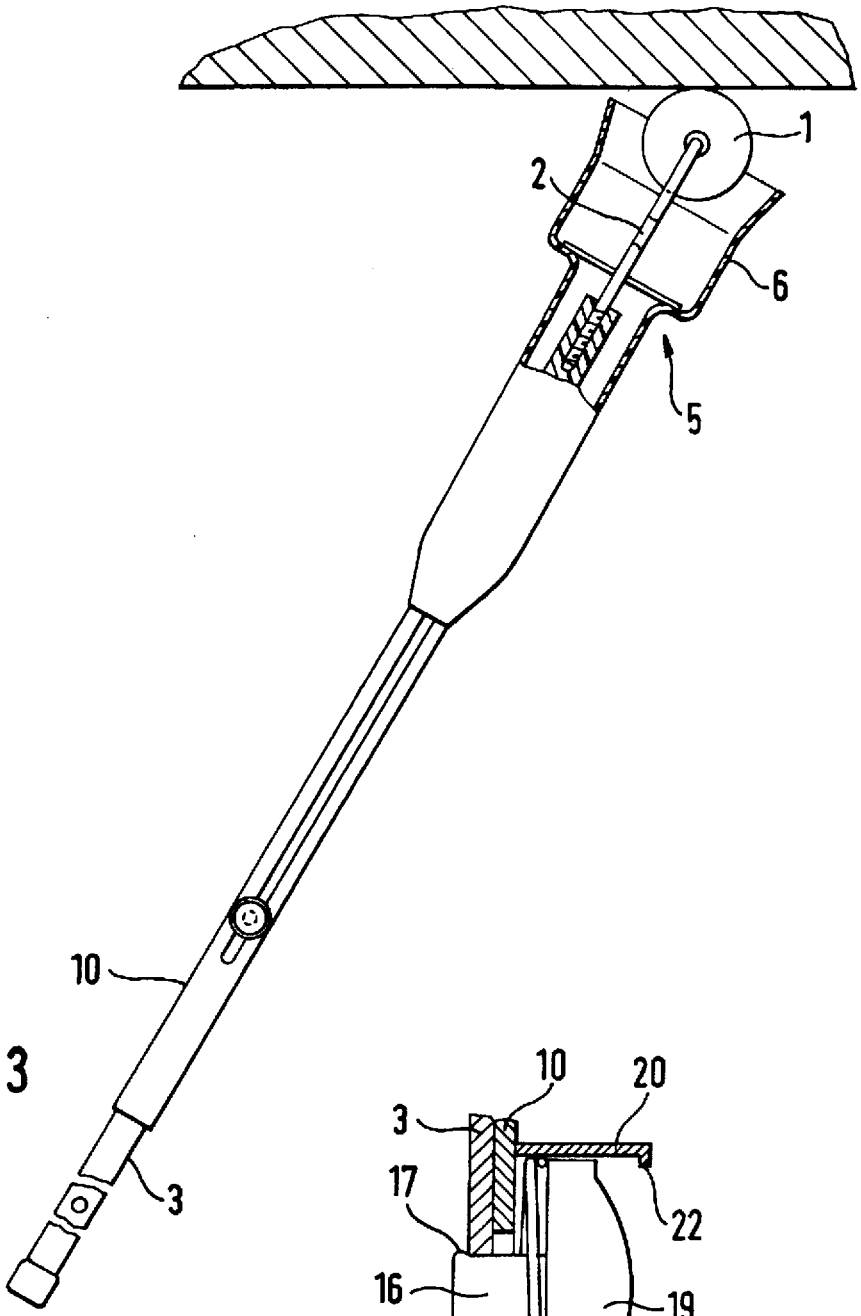
FIG. 3 is an example of the device for applying paint according to the present invention.

The handle 3 ensures a large handling radius. For example it is possible to paint ceilings and/or high room walls from the floor by means of the handle 3, as illustrated in FIG. 3. When applying paint on a surface like a room ceiling or wall, drops or sprays will come off the paint roller 1 due to the rotation of the paint roller 1 and/or the pressure applied by the paint roller 1. In order to collect these drops or sprays a device 5 or splashguard for the protection against paint sprays is provided. Thus it is not necessary to cover the room floor or the objects in the room.

Figure 1:
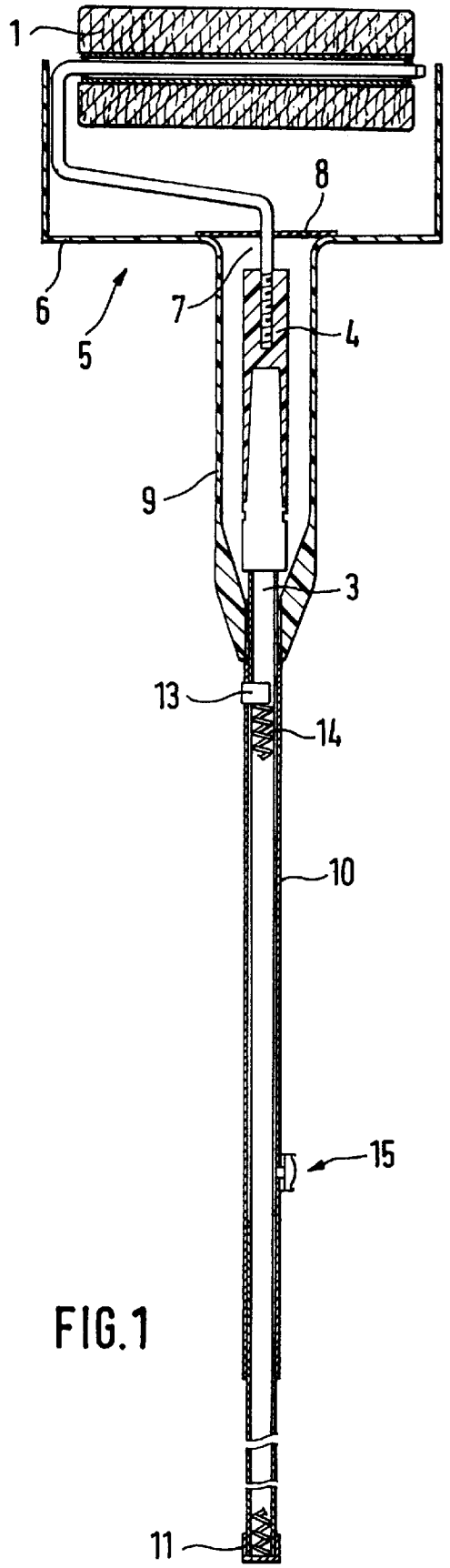
FIG. 1 is a view, partly in section of the device for applying paint according to the present invention.
Figure 2:
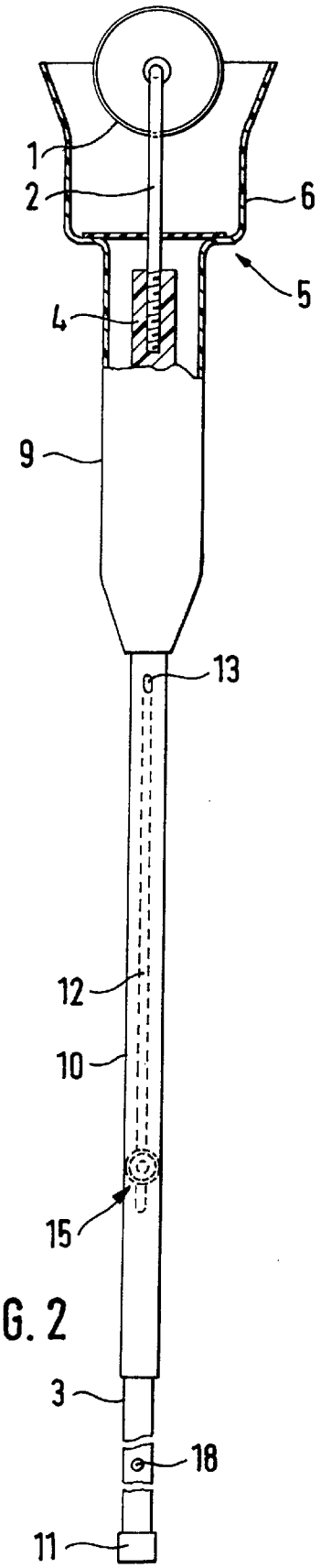
FIG. 2 is a side view of the device according to FIG. 1.

As illustrated in FIGS. 1 to 4 the device 5 for the protection against paint sprays consists of a tub 6 which in the working position as illustrated in FIGS. 1 to 3 encloses the lower part of the circumference of the paint roller 1 along the side of the stirrup. The bottom of the tub 6 is provided with a recess 7 assigned to the bent end piece of the stirrup 2 through which the bent end piece of the stirrup 2 is passed from the tub 6. The screwing together of the stirrup 2 and the handle 3 may accordingly be outside the tub 6. In the working position of FIGS. 1 to 3 the recess 7 can be closed by a plate 8 which is received by the end piece of the stirrup passing through the recess 7. Preferably, the plate 8 may be formed as a rubber disc which is put on the end piece of the stirrup and lies close in sealing position at the brim of the recess 7.

To the tub 6 a pot 9 is joined projecting away from the recess 7 in the direction of the stirrup carrier which is fastened with the remote end of the tub to a tube 10 which is received by the handle 3. The pot 9 and the tube 10 may be screwed together so that they can be easily loosened. The pot 9 acts as a spacer part which encloses the threaded sleeve 4 which is mounted on the handle 3, whereby the spacer part reaches to the tube which is mounted on the handle 3. The tub 6 and the pot 9 can be formed as one part, such as for example an injection-moulded part made of plastic. The tube 10 as well as the handle 3 can be made of aluminum or plastic.

The tube 10 is shorter than the handle 3 and arranged such that it can be moved from a front position adjacent to the threaded sleeve 4 into a back position, such as at a back closing cap 11 of the handle 3 and vice versa. Correspondingly, the tub 6 which is connected with the tube 10 via the pot 9 can be moved from a front working position of FIGS. 1 to 3 into which the bottom circumference of the paint roller 1 is immersed into the tub 6 into a retracted release position of FIG. 4 from where the paint roller 1 is pushed out of the tub 6 as it is immersed into a paint container and as it is wiped off on a grid. To ensure that the moving stroke is limited the tube with its front and/or back end runs into corresponding stoppers at the handle represented by the threaded sleeve 4. and/or a back closing cap 11. In the example best illustrated in FIG. 2 the handle 3 is provided with a vertical slot 12 into which reaches a tongue 13, fixed within the area of the front end of the tube 10, thus likewise ensuring a limitation of the mutual movability of handle 3 and tube 10 and therewith a limitation of the stroke of the device 5 for the protection against sprays. At the same time the tongue 13 reaching into the slot 12 ensures a reliable resistance against twisting so that the axes of the paint roller 1 and the tub 6 are always parallel and a collision-free immersing of the paint roller 1 into the tub 6 is automatically ensured.

As is obvious from FIG. 1 the handle 3 is formed as a tube. It contains a return spring 14 whose bottom end that is furthest from the paint roller lies close to the closing cap 11 which is put on the tube forming the handle 3, and whose opposite end that is near the paint roller lies close to the tongue 13 which reaches through the slot 12 and projects into the tube forming the handle 3. The tongue 13 therefore also serves as dolly for the return spring 14. The initial compression of the return spring 14 is increased when the tube 10 is retracted. This ensures a reliable retraction of the tube 10 and thus of the device 5 for the protection against sprays fixed thereto by means of the return spring 14 into the starting position of FIG. 1. The accommodation of the return spring 14 in handle 3 enables the use of a comparatively long and thus soft return spring, and therefore results in easy handling while at the same time reliable protection against injuries is assured.

Figure 4:
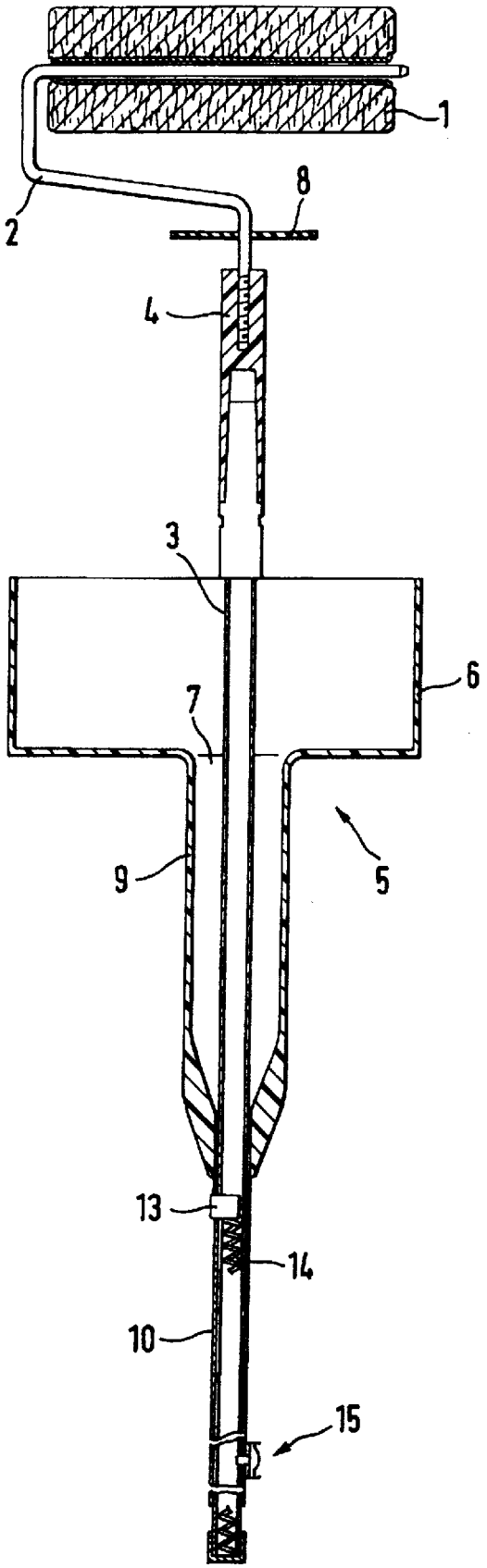
FIG. 4 is a view of the device for applying paint according to the present invention with retracted device for the protection against paint sprays.

To facilitate handling an engaging device 15 is provided by which the tube 10 and correspondingly the device 5 for the protection against sprays fixed thereto can be blocked against the power of the compressed return spring 14 in the retracted release position of FIG. 4. As is obvious from FIG. 5 the engaging device 15 contains a blocking pin 16 which is received by the tube 10 and is radially movable and which has at its inner end an undercut collar 17. The handle 3 possesses a recess 18 assigned to the blocking pin 16 which is placed such that the blocking pin 17 can be moved into the recess 18 in the retracted release position of FIG. 4 of the device 5 for the protection against sprays. Due to the effect of the compressed return spring 14 the blocking pin 16 comes to lie near the end of the recess 18 that is close to the paint roller whereby the collar 17 comes under the brim of this end of the recess. The blocking pin 16 reaching through the tube 10 projects out from a push button 19 which is received by a ring 20 that is laterally fixed to the tube 10; set underneath is a compression spring 21 acting as clutch spring. The outer end of the ring 20 is bent to the inside forming a stopper 21 for the push button 19 in its extended position. When in the extended position the blocking pin 16 is not in contact with the recess 18 at the side of the handle.

Figure 5:
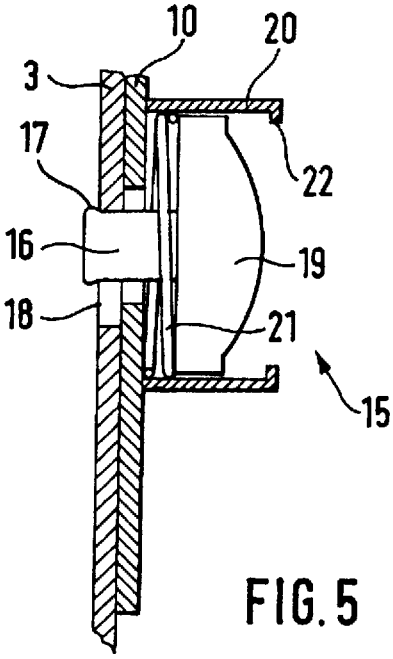
FIG. 5 is an enlarged view of the engaging device assigned to the device for the protection against paint sprays.

FIG. 5 shows the engaging position. In the disengaged position the tube 10 is retracted to such an extent that the collar 17 moves away from the brim of the recess 18. The compression spring 21 can thus move the push button 19 and with it the blocking pin 17 in an outward direction and bring it into contact at the stopper 21. In this position the blocking pin 16 is not in contact with the recess 18. The projection of the ring 20 exceeding the push button 19 corresponds at least to the wall thickness of the tube forming the handle 3 plus the thickness of the collar 17.

What is claimed is:

1. A device for applying paint on surfaces, comprising: a stirrup; a paint roller mounted on said stirrup in a rotatable manner; a stirrup carrier to which the stirrup is joined; and a splashguard for protection against paint sprays operatively associated with said paint roller, said splashguard being retractable from a work position, in which it surrounds the circumference of said paint roller at the side of the stirrup carrier in the manner of a tub, into a release position at which said paint roller can be released from said stirrup, wherein said splashguard is provided with an elongated pot which defines a recess, and wherein said stirrup carrier includes a screw connection located in said recess when said paint roller is in said work position.

2. The device according to claim 1, wherein said splashguard contains a tub with which said splashguard surrounds the circumference of said paint roller.

3. The device according to claim 1, further comprising: a tube, wherein said stirrup carrier further includes a handle which extends through said tube, and wherein said splashguard is attached to said tube.

4. The device according to claim 3, wherein said tube includes a pin-slot-connection, and wherein said tube resists twisting against said handle by means of said pin-slot-connection.

5. The device according to claim 1, wherein-said tub with said pot is a moulded part, which is separate from said tube and can be fixed thereto and detached.

6. The device according to claim 5, wherein said tub and said pot are plastic.

7. A device for applying paint on surfaces, comprising: a stirrup; a paint roller mounted on said stirrup in a rotatable manner; a return spring; a stirrup carrier to which the stirrup is joined; and a splashguard for protection against paint sprays operatively associated with said paint roller, said splashguard being retractable from a work position, in which it surrounds the circumference of said paint roller at the side of the stirrup carrier in the manner of a tub, into a release position at which said paint roller can be released from said stirrup, wherein said splashguard can be retracted against the force of said return spring from its working position.

8. The device according to claim 7, further comprising: a tongue; and a tube, wherein said stirrup carrier further includes a tube-shaped handle, said handle having a slot, and wherein said return spring is provided within said tube-shaped handle and is supported at one end by said handle and at the other end by said tongue connected to said tube, said tongue passing through said slot.

9. The device according to claim 7, further comprising: an engaging device, and wherein said splashguard can be blocked by said engaging device in at least the retracted release position.

10. The device according to claim 9, further comprising: a radially movable blocking pin; and a tube, wherein said stirrup carrier including a handle, and wherein said radially movable blocking pin is received by said tube, said blocking pin having an undercut collar which can be brought into contact with a recess at the side of said circumference of said handle.

11. The device according to claim 10, further comprising: a compression spring, and wherein said blocking pin is provided with a push button with said compression spring set between said push button and said tube.

12. A device for applying paint on surfaces, comprising: a stirrup; a paint roller mounted on said stirrup in a rotatable manner; a stirrup carrier to which the stirrup is joined; and a splashguard for protection against paint sprays operatively associated with said paint roller, said splashguard being retractable from a work position, in which it surrounds the circumference of said paint roller at the side of the stirrup carrier in the manner of a tub, into a release position at which said paint roller can be released from said stirrup, wherein said splashguard defines a recess, and said stirrup is provided with a plate which closes, in the working position, said recess.

13. The device according to claim 12, wherein said plate comprises a rubber disc which is put on the section of said stirrup at the side of said stirrup.

* * * * *